United States Patent [19]

Bertario

[11] 3,979,004

[45] Sept. 7, 1976

[54] BOTTLE CAP

[75] Inventor: Luigi Bertario, Milan, Italy

[73] Assignee: Alluminio Mauceri Borghetto S.p.A., Milan, Italy

[22] Filed: Dec. 11, 1974

[21] Appl. No.: 531,744

[30] Foreign Application Priority Data

Dec. 11, 1973 Italy ..... 3003/73[U]

[52] U.S. Cl. ..... 215/341; 215/354

[51] Int. Cl.[2] ..... B65D 53/00

[58] Field of Search ..... 215/260, 261, 270, 271, 215/307, 341, 350, 354

[56] References Cited

UNITED STATES PATENTS

| | | | |
|---|---|---|---|
| 3,057,501 | 10/1962 | Kroenert | 215/354 |
| 3,317,069 | 5/1967 | Chin | 215/354 |
| 3,318,496 | 5/1967 | Ayotte | 215/307 |

FOREIGN PATENTS OR APPLICATIONS

| | | | |
|---|---|---|---|
| 257,279 | 2/1965 | Australia | 215/354 |
| 504,063 | 7/1951 | Belgium | 215/354 |
| 1,112,159 | 11/1955 | France | 215/354 |
| 1,159,427 | 6/1958 | France | 215/354 |
| 1,372,671 | 10/1964 | France | 215/354 |
| 98,315 | 8/1953 | Norway | 215/354 |

*Primary Examiner*—Ro E. Hart

*Attorney, Agent, or Firm*—Cushman, Darby & Cushman

[57] ABSTRACT

A cap and stopper assembly for bottles is disclosed, in which the stopper is capable of being engaged by the top portion of the cap permanently and is so shaped as to cooperate with an undercut formed in the inner wall of the bottle mouth so as to ensure a tight seal, the stopper being bodily removed with the cap as the latter is unscrewed from the screw-threaded outer wall of the bottle mouth.

3 Claims, 2 Drawing Figures

BOTTLE CAP

This invention relates to a metal cap for stoppering glass bottles, the cap having a plug for preventing liquid seepage.

The mouth of glass bottles has often conspicious burrs on both the edge and the inner wall in the vicinity of the edge.

The presence of said burrs makes unsatisfactory the tightness of seals which usually cooperate with the cap as applied to the cap bottom.

To obviate this defect the use has already been suggested of a stopper providing a circumferential seal on a comparatively wide area of the inner wall of the mouth.

This approach, however, originates the problem of the removal of the stopper together with the cap. It could be imagined to cement the stopper top portion to the cap bottom by means of an appropriate adhesive cement. Such a suggestion, however, should be put aside since the frictional forces acting on the stopper are often greater than the twist torque to be applied to the cap as the latter is being unscrewed. Consequently, as the cap is being unscrewed, it would become separated from the stopper, the latter remaining positioned in the bottle.

The invention solves this problem in a particularly brilliant and advantageous way by providing a cap and stopper assembly in which the stopper has a comparatively resiliently yieldable flared wall which is adapted to be engaged by a complementary undercut formed on the inner wall of the bottle mouth and a bead surrounding the edge of said mouth, said bead cooperating with an annular inner ledge of the capsule as formed immediately therebeneath.

By so doing, as the cap is being unscrewed, the stopper, which is only freely slipped in the cap with its bead between the cap bottom and the ledge, is withdrawn together with the cap due to the upward axial thrust as impressed by the ledge to the bead.

Figure 2:
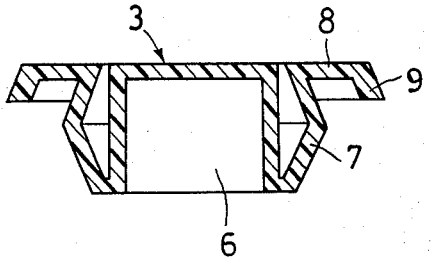
Figure 1:
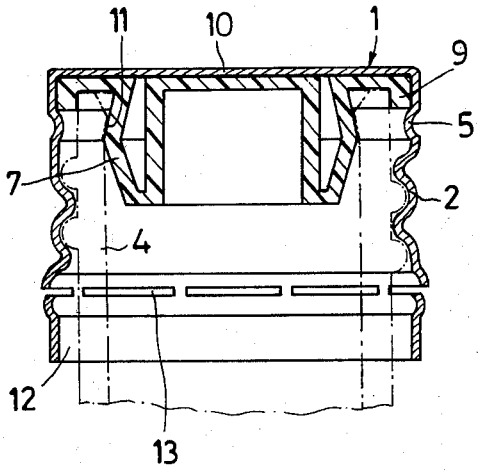

In order that the structural and functional features of the invention may be better understood, a practical embodiment thereof is described hereinafter with reference to the accompanying drawings, wherein:

FIG. 1 is a cross-sectional view showing a cap according to the invention, as screwed onto a bottle mouth, and FIG. 2 is a cross-sectional view showing the sealing stopper only cooperating with the cap.

In the drawings, the reference numeral 1 generally indicates a cap-stopper assembly made according to the invention.

The metal cap 2 is rolled over a screw-threaded mouth of a bottle 4 and, characteristically, has an inner annular ledge 5.

The stopper 3, made of a comparatively resiliently yieldable material, has a central cylindrical body 6 carrying an outer circumferential wall 7 exhibiting a twinconical shape. From the top of the wall 7 there extends an annular flange 8 whose edge 9 is flared to form a bead.

The stopper 3 thus constructed is forcibly introduced in the interior of the cap 2, so that its edge or bead 9 becomes deformed and housed between the wall 10 of the cap 2 and the ledge 5.

As the cap-stopper assembly is applied to the mouth 4, the wall 7 is deformed, as shown in FIG. 1, due to the presence of a complementary annular undercut 11 on the inner wall of the mouth, the stopper 3 displaying its sealing action against the undercut.

As the cap is screwed on, it can easily be understood that the ledge 5 impressed an axial thrust on the bead 9. The latter, also on account of the radial thrust impressed by the mouth thereon, remains steady in position between the ledge 5 and the end wall 10, so that the stopper 3 is integrally withdrawn together with the capsule.

At 12 there is shown a conventional guaranty strip which is connected to the cap body by a rupture line 13.

The cap according to the invention thus achieves the above indicated purpose of ensuring a reliable seal by using a stopper which can be bodily withdrawn with the cap itself.

What I claim is:

1. A cap-and-stopper assembly for closing a bottle having an exteriorly threaded mouth, comprising a screw cap and a resilient stopper located inside the cap, the cap being formed by an end wall and by a lateral wall provided with internal threads and the stopper including a twin-conical wall tapered toward opposite ends and adapted to engage the inner wall of the bottle mouth and a peripheral bead coaxial with the twin-conical wall and held between the end wall of the cap and an annular inner ledge of the lateral wall of the cap so that the stopper will be removed from the bottle mouth when the cap is unscrewed from the bottle, said stopper further includes a central cylindrical closed body, from which the twin-conical wall coaxially extends, and an annular flange which connects said twin-conical wall to the peripheral bead.

2. An assembly as in claim 1 wherein the peripheral bead of the stopper is resiliently stressed to a flared outline.

3. An assembly as in claim 1 wherein the cap comprises a guaranty strip connected to the lateral wall by rupturable joints.

* * * * *